United States Patent [19]

Maezima

[11] 4,136,322

[45] Jan. 23, 1979

[54] SINGLE-PHASE THREE-LEGGED CORE FOR CORE TYPE TRANSFORMER

[75] Inventor: Masaaki Maezima, Hitachi, Japan

[73] Assignee: Hitachi, Ltd., Japan

[21] Appl. No.: 746,000

[22] Filed: Nov. 30, 1976

[30] Foreign Application Priority Data

Dec. 5, 1975 [JP] Japan ..... 50-145412

[51] Int. Cl.[2] ..... H01F 27/08; H01F 27/26

[52] U.S. Cl. ..... 336/60; 336/217

[58] Field of Search ..... 310/216, 217, 218; 336/216, 217, 214, 215, 60

[56] References Cited

U.S. PATENT DOCUMENTS

| | | | |
|---|---|---|---|
| 2,300,964 | 11/1942 | Putman | 336/214 X |
| 2,407,625 | 9/1946 | Brand | 336/217 X |
| 3,064,220 | 11/1962 | Specht | 336/217 |
| 3,069,643 | 12/1962 | Stein et al. | 336/217 |
| 3,129,377 | 4/1964 | Monroe et al. | 336/217 X |
| 3,183,461 | 5/1965 | Tipton | 336/217 X |
| 3,283,281 | 11/1966 | Stein et al. | 336/217 |
| 3,569,886 | 3/1971 | Specht | 336/217 |
| 3,743,991 | 7/1973 | Gumpper et al. | 336/217 |

*Primary Examiner*—Thomas J. Kozma

*Attorney, Agent, or Firm*—Craig & Antonelli

[57] ABSTRACT

A single-phase three-legged core for a core type transformer in which a plurality of steel sheets constituting each layer of laminations of a main leg are jointed at their diagonally cut sides to corresponding sides of a plurality of steel sheets constituting each layer of laminations of yokes to form a plurality of joints. At the inner corner portion of each joint, a recess is provided along the main leg or yoke steel sheet having a greater width than the other, so that a plurality of main leg laminations having stepwise varying width can be jointed to a plurality of yoke laminations at the same joint angle in the area of the recesses thereby simplifying the step of sheet cutting. At the outer corner portion of some of the joints, the vertex of the diagonally cut side of the corresponding main leg steel sheet mates with that of the associated yoke steel sheet to provide an outer corner joint, so that magnetic flux can uniformly pass through the joints to minimize the core loss.

12 Claims, 20 Drawing Figures

SINGLE-PHASE THREE-LEGGED CORE FOR CORE TYPE TRANSFORMER

BACKGROUND OF THE INVENTION

1. FIELD OF THE INVENTION

This invention relates to a single-phase three-legged core for a core type transformer, and more particularly to the structure of joints between its main leg and yokes.

2. DESCRIPTION OF THE PRIOR ART

Transportation means such as railroads and trailers are utilized for transporting power transformers to power generating stations, substations, etc. The height of these transformers is limited to a predetermined value so as not to provide a hindrance against tunnels and land bridges which may exist in the route of transportation. Such limitation is commonly called a transport restriction. A single-phase three-legged core structure 10 as shown in FIGS. 1A and 1B is advantageously employed when there is a severe transport restriction. The single-phase three-legged core structure 10 shown in FIGS. 1A and 1B comprises a main leg 1, a pair of side legs 2, and a pair of upper and lower yokes 3 magnetically coupled to the main leg 1 and side legs 2. In the core structure 10 shown in FIGS. 1A and 1B, the width of the yokes 3 is about half the width of the main leg 1, and therefore, the height of the transformer can be reduced correspondingly.

FIGS. 2A and 2B show two forms of a steel sheet 2', for example, an oriented silicon steel sheet which has a pair of diagonally cut sides C formed by cutting the end portions at an angle of 45° relative to the longitudinal direction to extend between the inner side A and the outer side B. A plurality of steel sheets 1*a*, 1*b*; 2*a*, 2*b*; and 3*a*, 3*b* having shapes as shown in FIGS. 2A and 2B are laminated in layers of laminations to constitute the main leg 1, side legs 2 and yokes 3 respectively. These steel sheets are jointed in such a relation that the main leg steel sheets 1a and 1b constituting one layer of the main leg 1 are disposed in side-by-side relation to define an oil duct g therebetween, with their outer sides B confronting each other and their diagonally cut sides C arranged symmetrically. The main leg steel sheets 1*a* and 1*b* are jointed to the yoke steel sheets 3*a* and 3*b* to form joints X. The steel sheets 1*a*, 1*b*, 2*a*, 2*b*, 3*a* and 3*b* are laminated into layers of laminations while being jointed in the above manner to provide the main leg 1, side legs 2 and yokes 3.

FIGS. 3A and 3B show the sectional shapes of the main leg 1 and one of the yokes 3 when sections are taken along the lines IIIA—IIIA and IIIB—IIIB in FIG. 1A respectively. It will be seen from FIGS. 3A and 3B that the main leg 1 is substantially circular in cross-section, while the yoke 3 is rectangular in cross-section. Although the yoke 3 is shown as having the rectangular cross-sectional shape, it may have a non-circular cross-sectional shape such as a semi-elliptical or elliptical cross-sectional shape. The rectangular yokes 3 shown in FIGS. 3B are provided with oil ducts g' in communication with the oil duct g. In fact, the yoke 3 in FIG. 3B has a rear position in which the yoke 3 shown in FIG. 3B is rotatively moved by 90° with the longitudinal direction of the yoke being made horizontal, however, in this FIG. 3B the yoke 3 is shown to show the relation thereof corresponding to each unit block 6 of the iron core shown in FIG. 3A. While these cross-sectional shapes of the main leg 1 and yokes 3 shown in FIGS. 3A and 3B are one of the features of the core structure for a core type transformer, these shapes give rise to a problem described hereunder.

A plurality of main leg steel sheets 1*a* and 1*b* of the same shape are laminated to constitute a core unit block 6, and a plurality of such core unit blocks 6 having stepwise varying width are stacked in tiers to constitute the main leg 1 of substantially circular cross-sectional shape as shown in FIG. 3A. In the main leg 1 thus constructed, the individual core unit blocks 6 are composed of the steel sheets 1*a* and 1*b* of different widths $l_{11}$ to $l_{18}$ as shown, and the width increases gradually toward the central unit block 6. Therefore, a problem as described below arises when a plurality of main leg steel sheets 1*a* and 1*b* having varying width are jointed to a plurality of yoke steel sheets 3*a* and 3*b* having the same width. Referring to FIGS. 1A and 1B again, the joints X between the main leg steel sheets 1*a* and 1*b* and the yoke steel sheets 3*a* and 3*b* have a joint angle of 45°. In order that the main leg 1 of substantially circular cross-sectional shape can be jointed to the yokes 3 of non-circular cross-sectional shape at the joint angle above specified, many steel sheets 2' providing the main leg or yoke steel sheets of greater width must be clipped at both ends or one end as shown by F in FIGS. 2A and 2B so as to provide clipped ends or end D. This end clipping operation is time-consuming and will remarkably reduce the yield rate. Further, a main leg steel plate adjacent the main leg steel plate 1*a* forming the joint portion X shown in FIG. 1A is placed such that the main leg steel plate 1*a* is inverted by 180° with the end D being disposed at the lower side, so that the vertices of the diagonally cut side of the main leg steel plates 1*a* and yoke steel plates 3*a* are not consistent with each other. Thus, in this case, magnetic flux does not flow through the end D, which matter causes the same problem as in FIG. 4A explained hereinbelow.

FIG. 4A shows the flow of magnetic flux $\phi$ at the joint X. It will be seen in FIG. 4A that the magnetic flux $\phi$ is relatively concentrated in the area of the inner corner of the joint X and does not substantially flow through the area of the outer corner of the joint X due to the presence of the clipped end D, and all the area of the steel sheet laminations of greater width constituting the main leg portion is not fully effectively utilized. Thus, the prior art core structure has been defective in that local losses of the magnetic flux flow lead to an undesirable increase in the core loss.

A single-phase two-legged core structure as shown in FIG. 5 has been proposed in an effort to obviate such a non-uniform magnetic flux distribution. The proposed core structure shown in FIG. 5 is quite effective in uniformalizing the magnetic flux distribution. In this core structure, however, the joint line 8 between a main leg steel sheet 1*a* and a yoke steel sheet 3*a* in one of the core layer is in the form of a straight line $\overline{ST}$ extending from an inner corner point S to an outer corner point T at an angle of $\theta_1$, while the joint line 9 in the adjacent core layer is provided by a straight line $\overline{SU}$ extending from the same inner corner point S to another point U at an angle of $\theta_2$. Therefore, the degree of overlap of such adjoining layers increases from the inner corner point toward the outer corner point.

Thus, in the core structure shown in FIG. 5, the lap dimension (the overlapping area of the adjoining layers) is reduced at the inner corner side, and the steel sheets 1*a* and 3*a* are butted to provide a butt joint. In the proposed core structure, therefore, errors that may occur during the steps of stacking and insertion of the steel sheets tend to give rise to formation of a gap which leads to various adverse effects and instability of the quality. This is because the magnetic reluctance increases in the area of the inner corner portion of the core, resulting in an excessive increase in the core loss and exciting current.

When the proposed joint structure is applied to a single-phase three-legged core structure, a variety of joint angles equal to the number of stepped lap joints are required resulting in time-consuming angle adjustment. In addition, due to the fact that the existence of the butt joints in the inner portion of the core increases the magnetic reluctance in that portion, the magnetic flux will be concentrated in the outer portion of the core to increase rather the core loss.

According to another prior art practice, steel sheets 2 used to constitute, for example, the yoke are cut from a coil 2' and have a pair of sides cut diagonally at angles of $\theta_1$ and $\theta_2$ respectively as shown in FIG. 6. The steel sheet 2 having the vertex of angle $\theta_2$ at the front end or in the advancing direction X is clipped as shown by E to provide a clipped end D. This manner of end clipping is only applicable to alternate ones of the steel sheets 2, that is, those having the vertex of angle $\theta_2$ in the advancing direction. This is because the steel sheet 2 having the vertex of angle $\theta_2'$ in the direction opposite to the advancing direction X is difficult to be engaged by a stopper 15, whereas that having the vertex of angle $\theta_2$ in the advancing direction X can be easily engaged by the stopper 15. In order to clip the former steel sheets 2, another cutter must be separately provided resulting in a complex cutting step.

SUMMARY OF THE INVENTION

It is an object of the present invention to provide a single-phase three-legged core for a core type transformer comprising a main leg of substantially circular cross-sectional shape constituted by laminating a plurality of steel sheets into layers of laminations of different widths and a pair of yokes of non-circular cross-sectional shape constituted by laminating a plurality of steel sheets into layers of laminations of equal width, in which a plurality of main leg steel sheets constituting the main leg laminations of different widths are jointed at the diagonally cut sides to the corresponding sides of a plurality of yoke steel sheets constituting the yoke laminations of equal width at the same joint angle, thereby reducing the steps of cutting operation and the number of cutting angles to improve the manufacturing efficiency.

Another object of the present invention is to provide a single-phase three-legged core for a core type transformer in which a plurality of such main leg steel sheets constituting the main leg laminations are jointed at a plurality of joints to a plurality of such yoke steel sheets constituting the yoke laminations, and the vertex of the diagonally cut side of each of the main leg steel sheets mates with that of the diagonally cut side of each of the yoke steel sheets to provide an outer corner point, so that magnetic flux can uniformly flow through the joints to minimize the core loss.

In the single-phase three-legged core according to the present invention, a plurality of steel sheets constituting each layer of laminations of a main leg are jointed at their diagonally cut sides to corresponding sides of a plurality of steel sheets constituting each layer of laminations of a pair of yokes to form a plurality of joints, and at the inner corner portion of each joint, a recess is provided along the main leg or yoke steel sheet having a greater width than the other, while at the outer corner portion of some of the joints, the vertex of the diagonally cut side of the corresponding main leg steel sheet mates with that of the associated yoke steel sheet to provide an outer corner point, so that a plurality of main leg laminations having stepwise varying width can be jointed to a plurality of yoke laminations at the same joint angle in the area of the recesses, and magnetic flux can uniformly pass through the joints having the outer corner points to minimize the core loss.

DESCRIPTION OF THE PREFERRED EMBODIMENTS

Figure 7A:
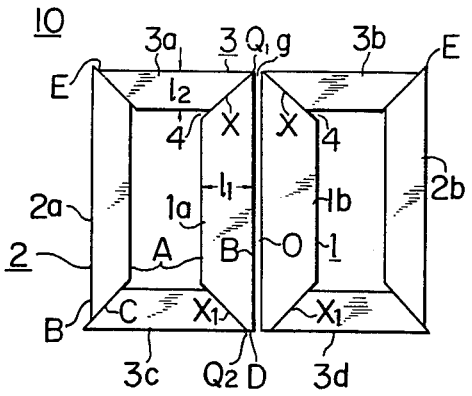
FIGS. 7A and 7B show the structure of an embodiment of the single-phase three-legged core according to the present invention.
Figure 7B:
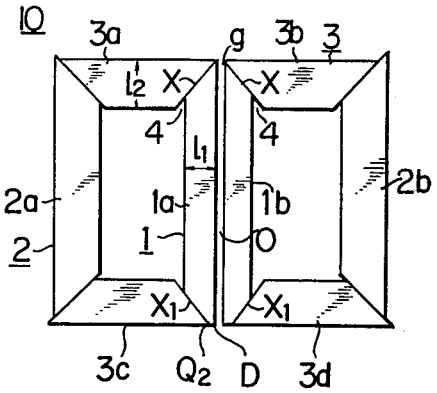
Figure 8:
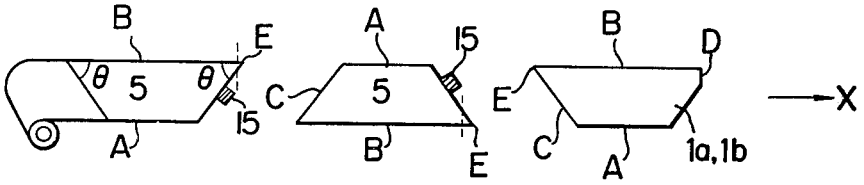
FIG. 8 shows schematically the shape of main leg steel sheets being cut to constitute the layers of laminations of the main leg of the core shown in FIGS. 7A and 7B.

An embodiment of the single-phase three-legged core for a core type transformer according to the present invention will be described with reference to FIGS. 7A and 7B. Referring to FIGS. 7A and 7B, the single-phase three-legged core is generally designated by the reference numeral 10 and comprises a main leg 1, a pair of side legs 2, and a pair of upper and lower yokes 3 magnetically coupled to the main leg 1 and side legs 2. The main leg 1, side legs 2 and yokes 3 are constituted by laminating a plurality of main leg steel sheets **1*a* and 1*b*, side leg steel sheets 2*a* and 2*b*, and yoke steel sheets 3*a*, 3*b*, 3*c* and 3*d* respectively into layers of laminations. Referring to FIG. 8, each of these steel sheets is cut into a trapezoidal shape having a pair of diagonally cut sides C extending between the inner side A and the outer side B. In the case of the main leg steel sheets 1*a* and 1*b* constituting each layer of laminations of the main leg 1, one of the diagonally cut sides C is additionally clipped in the area of the vertex E to provide a clipped end D. These steel sheets are jointed together to constitute each layer of laminations of the main leg 1, side legs 2 and yokes 3. In jointing these steel sheets to form one core layer, the steel sheets 1a and 1b of the same shape constituting the main leg lamination are disposed to confront each other at their outer sides B while defining an oil duct g therebetween, and the steel sheets 2a and 2b constituting the side leg lamination are disposed on the opposite sides of the main leg steel sheets 1a and 1b with their inner sides A confronting each other. The steel sheets 3a, 3b, 3c and 3d constituting the upper and lower yoke lamination are jointed between the main leg steel sheets 1a, 1b and the side leg steel sheets 2a, 2b** to be magnetically coupled thereto. The steel sheets providing the adjacent layer are laminated in a 180° inverted relation around the point O.

Figure 9A:
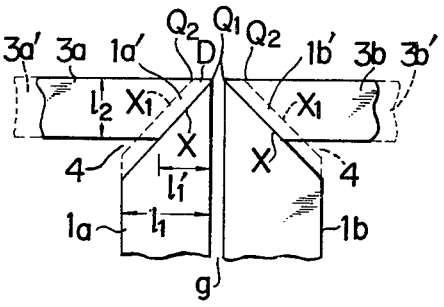
FIGS. 9A and 9B and FIG. 10 show schematically part of the joints between the main leg steel sheets and the yoke steel sheets shown in FIGS. 7A and 7B.
Figure 9B:
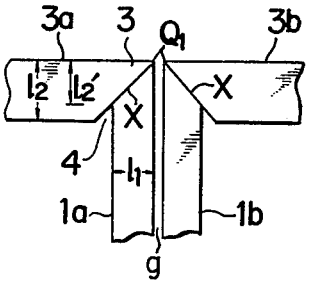

A pair of joints X are formed between the upper diagonally cut sides C of the main leg steel sheets 1a, 1b and the corresponding ones C of the yoke steel sheets 3a, 3b, and as will be seen in FIGS. 7A and 7B, the vertex E of the main leg steel sheet 1a mates with that of the yoke steel sheet 3a to provide an outer corner point $Q_1$. Such an outer corner point is also provided by the steel sheets 1b and 3b. Another pair of joints $X_1$ are formed between the lower diagonally cut sides C of the main leg steel sheets 1a, 1b and the corresponding ones C of the yoke steel sheets 3c and 3d. In the case of the latter joints $X_1$, however, the vertex E of the main leg steel sheet 1a does not mate with that of the yoke steel sheet 3c to provide a jointed point $Q_2$. Such a jointed point is also provided between the steel sheets 1b and 3d. In FIGS. 9A and 9B in which the main leg steel sheets 1a and 1b are inverted 180° from the state shown in FIGS. 7A and 7B, main leg steel sheets 1a' and 1b' adjoining the main leg steel sheets 1a and 1b form a pair of joints $X_1$ at their upper diagonally cut sides with the corresponding sides of yoke steel sheets 3a' and 3b'. In each of these joints $X_1$, the vertex E of the diagonally cut side does not mate with that of the associated diagonally cut side to provide a jointed point $Q_2$. It will be seen in FIG. 9A that the jointed point $Q_2$ is displaced from the outer corner point $Q_1$ by the distance corresponding to the length of the clipped end D. In other words, the clipped end D of each of the main leg steel sheets 1a' and 1b' aligns with the vertex E of each of the yoke steel sheets 3a' and 3b'.

Another pair of joints X are formed between the lower diagonally cut sides C of the main leg steel sheets 1a', 1b' and the corresponding ones of yoke steel sheets 3c' and 3d'. That is, when a pair of joints X are formed in one core layer, another pair of joints $X_1$ are formed in the corresponding position in the adjacent layer, although the above order can be freely selected. Due to the fact that the main leg steel sheets 1a and 1b in one layer are inverted 180° from those in the adjoining layer, the individual joints in one layer do not register with those in the adjoining layer, thereby providing the lap joints. Recesses 4 are shown formed at the inner corners of these joints in FIGS. 7A and 7B, in order that a plurality of main leg steel sheets constituting the laminations of stepwise varying width can be jointed at their diagonally cut sides to the corresponding sides of a plurality of yoke steel sheets constituting the laminations of equal width.

Referring to FIG. 7A, the width $l_1$ of the main leg steel sheets 1a and 1b is greater than the width $l_2$ of the yoke steel sheets 3a and 3b. Therefore, a recess 4 is formed at the inner corner of each of the joints X. Referring to FIG. 7B, the width $l_2$ of the yoke steel sheets 3a and 3b is greater than the width $l_1$ of the main leg steel sheets 1a and 1b, and therefore, a recess 4 is formed at the inner corner of each of the joints X. It will thus be seen that such recess 4 is formed at the inner corner of the jointed area of the main leg or yoke steel sheet having a greater width than that of the associated yoke or main leg steel sheet.

Referring to FIG. 9A, the recess 4 is formed at the inner corner of the jointed area of the main leg steel sheet 1a when the width $l_1$ of this steel sheet 1a is larger than the width $l_2$ of the associated yoke steel sheet 3a, that is, when the relation $l_1 > l_2$ holds, and the effective width $l_1'$ of the joint X provided by subtracting at least the width of the recess 4 from $l_1$ is selected to be greater than the width $l_2$ of the yoke steel sheet 3a. In the range of $l_1 < l_2$, the recess 4 is formed at the inner corner of the jointed area of the yoke steel sheet 3a, and the effective width $l_2'$ of the joint X is similarly greater than the width $l_1$ of the main leg steel sheet 1a as seen in FIG. 9B. The maximum width of these recesses 4 is about 10% of the width $l_1$ of the main leg steel sheet 1a or the width $l_2$ of the yoke steel sheet 3a.

It will be seen from the above description that, in the single-phase three-legged core according to the present invention, the joints X formed by jointing the diagonally cut sides of the main leg steel sheets 1a and 1b constituting the layers of laminations of the main leg 1 to the corresponding ones of the yoke steel sheets 3a and 3b constituting the layers of laminations of the yokes, include the recesses 4 formed at the inner corners of the jointed area of the main leg steel sheets 1a, 1b or yoke steel sheets 3a, 3b having a greater width than the other. These joints X include further the outer corner points $Q_1$ provided by the mating vertices E of the diagonally cut sides C of the associated ones of the steel sheets 1a, 1b, 3a and 3b.

The present invention having the above features provides various advantages as described below.

Figure 1A:
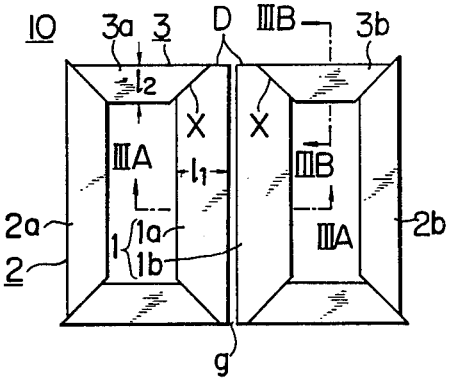
FIG. 1A (PRIOR ART)
FIGS. 1A and 1B show the structure of a prior art single-phase three-legged core.
Figure 1B:
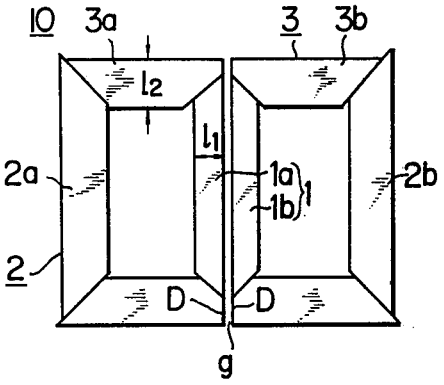
Figure 2A:
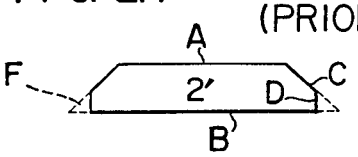
FIG. 2A (PRIOR ART)
FIGS. 2A and 2B show schematically the shape of main leg steel sheets constituting the layers of laminations of the main leg shown in FIGS. 1A and 1B.
Figure 2B:
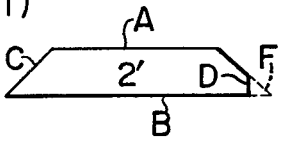
Figure 3A:
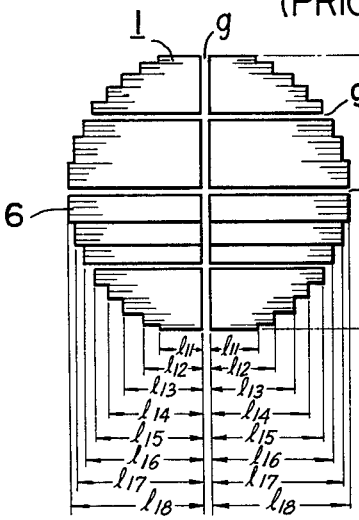
FIG. 3A (PRIOR ART)
FIGS. 3A and 3B are enlarged sectionl views taken along the lines IIIA—IIIA and IIIB—IIIB respectively in FIG. 1A.
Figure 3B:
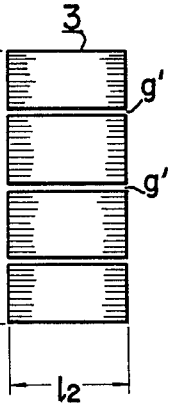

In the first place, the main leg steel sheets constituting the main leg laminations of stepwise varying width can be jointed at the same joint angle. It will be seen in FIG. 7A that the recess 4 is formed at the inner corner of the joint X between the main leg steel sheet 1a of larger width and the yoke steel sheet 3a of smaller width. Therefore, when a main leg steel sheet 1a having a width $l_{12}$ and another main leg steel sheet 1a' having a smaller width $l_{11}$ are laminated, the inner corner portions of the diagonally cut sides of these steel sheets are disposed in the recess 4, so that the main leg steel sheets 1a and 1a' having the respective widths $l_{12}$ and $l_{11}$ can be jointed to the associated yoke steel sheets 3a and 3a' at the same joint angle $\theta$. Since the main leg steel plates 1a and 1a' respectively having width $l_{11}$ and $l_{12}$ can have the same joint angle $\theta$, this means that the joints of the yoke and main leg steel plates can be effected by use of four kinds of joints even when the main leg steel plates have eight different widths as in the case of FIG. 3A. Thus, the number of cutting angles and the steps of cutting operation can be reduced to improve the manufacturing efficiency.

Further, due to the fact that the main leg steel sheets 1a and 1b constituting the main leg laminations have the diagonally cut sides C cut at the same angle $\theta$, one of the vertices E of the diagonally cut sides C may merely be partly clipped to provide the clipped end D as shown in FIG. 8, thereby simplifying the clipping operation and reducing the steps of clipping which improve the yield rate. Furthermore, only one stopper 15 may be disposed on the side of, for example, the advancing direction X of the main leg steel sheets 1a and 1b to stop the advancing movement of these steel sheets advancing in the direction of the arrow X. Thus, these steel sheets 1*a* and 1*b* can be easily stopped, and the stopper mechanism can be simplified.

Figure 4A:
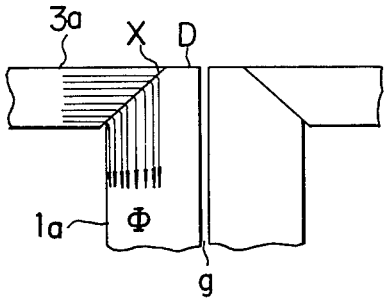
FIGS. 4A and 4B are partial views showing the mode of magnetic flux flow through the joint between a main leg steel sheet and a yoke steel sheet.
Figure 4B:
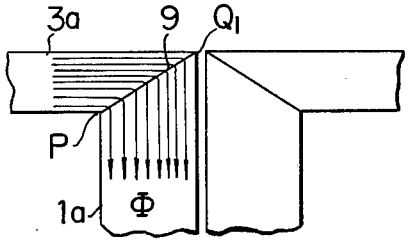
Figure 5:
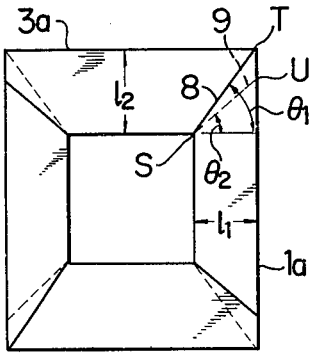
FIG. 5 (PRIOR ART)
FIG. 5 shows the structure of a prior art single-phase two-legged core.
Figure 6:
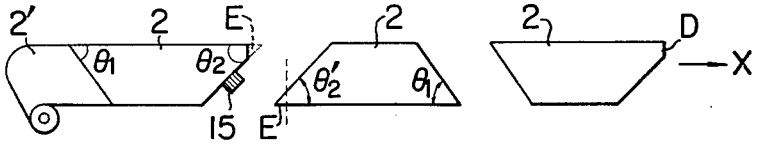
FIG. 6 (PRIOR ART)
FIG. 6 shows schematically the shape of yoke steel sheets being cut to constitute the layers of laminations of the yoke.
Figure 10:
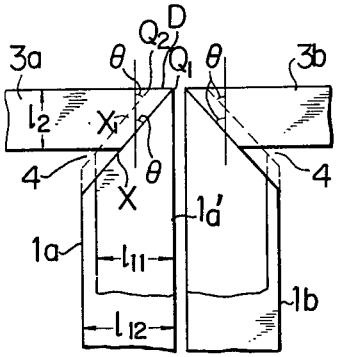

In the second place, the vertices E of the diagonally cut sides C of, for example, the steel sheets 1*a* and 3*a* mate with each other to provide the outer corner point $Q_1$ at the outer corner of the joint X among the joints X and $X_1$ shown in FIGS. 9A and 10. Therefore, magnetic flux $\phi$ passes uniformly through the joint X as shown in FIG. 4B, and the tendency toward concentration of the magnetic flux in the inner corner area of the joint X can be avoided to minimize the core loss. Referring to FIGS. 9A and 9B, the relation:

$l_2 < l_1' < l_1$ $(l_1 < l_2' < l_2)$ holds among the width $l_1$ of the main leg steel sheets 1*a* and 1*b* constituting the main leg laminations, the width $l_2$ of the yoke steel sheets 3*a* and 3*b* constituting the yoke laminations, and the effective widths $l_1'$ and $l_2'$ of the joints X between the main leg steel sheets 1*a*, 1*b* and the yoke steel sheets 3*a*, 3*b*. Suppose that $B_1$, $B_2$, $B_1'$ and $B_2'$ represent the magnetic flux density in the main leg steel sheets 1*a* and 1*b* constituting the main leg laminations, that in the yoke steel sheets 3*a* and 3*b* constituting the yoke laminations, that in the joint X between the steel sheets 1*a* and 3*a*, and that in the joint X between the steel sheets 1*b* and 3*b* respectively. Then, these magnetic flux densities have the following relation:

$B_2 > B_1' > B_1$ $(B_1 > B_2' > B_2)$.

Therefore, the magnetic flux density $B_1'$ $(B_2')$ in the joint X is lower than the magnetic flux density $B_2$ in the yoke steel sheet 3*a* when its width in less than that of the main leg steel sheet 1*a* (or higher than the magnetic flux density $B_1$ in the main leg steel sheet 1*a* when its width is smaller than that of the sheet 3*a*). Thus, the tendency toward undesirable local concentration of the magnetic flux can be obviated. Further, due to the fact that the steel sheets are fully jointed together except the recesses 4, the joint area is wide which is further effective in obviating the tendency toward local concentration of the magnetic flux.

The vertex E of each of the upper diagonally cut sides of the steel sheets 2*a* and 2*b* constituting the side leg laminations may be clipped in parallel with the outer side B of each of the associated yoke steel sheets 3*a* and 3*b* in, for example, FIG. 7A, so that they may not provide hindrance against the leads disposed thereabove. In such a case, the joints do not include the outer corner points.

Other embodiments of the present invention will be described with reference to FIGS. 11A, 11B and FIGS. 12A, 12B.

Figure 11A:
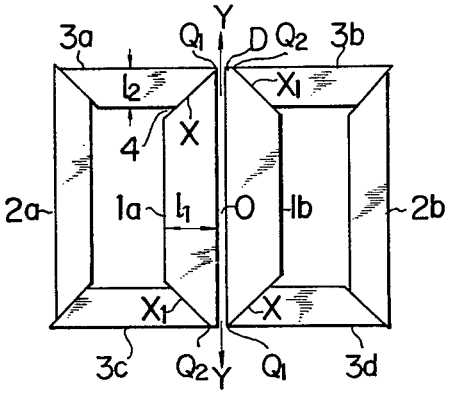
FIG. 11A and 11B show the structure of another embodiment of the present invention.
Figure 11B:
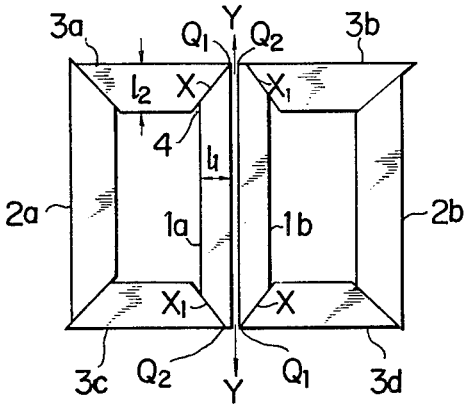

FIGS. 11A and 11B show another embodiment of the single-phase three-legged core according to the present invention. Referring to FIGS. 11A and 11B, a pair of main leg steel sheets 1*a* and 1*b* constituting one layer of laminations of a main leg 1 are arranged in relatively inverted relation although they have the same shape. These main leg steel sheets 1*a* and 1*b* are jointed to yoke steel sheets 3*a* and 3*b* constituting one layer of lamination of an upper yoke 3 to form a pair of joints X and $X_1$. At the joint X, the vertex of the diagonally cut side of the main leg steel sheet 1*a* mates with that of the diagonally cut side of the yoke steel sheet 3*a*, and at the joint $X_1$, the clipped end D of the main leg steel sheet 1*b* mates with the vertex of the diagonally cut side of the yoke steel sheet 3*b*. The above relation is reversed in the lower joints. In the layer adjoining that shown in FIGS. 11A and 11B, the pattern is inverted with respect to the axis Y—Y. Thus, the upper joints X and $X_1$ in the former layer adjoin the upper joints $X_1$ and X respectively in the latter layer, and the lower joints $X_1$ and X in the former layer adjoin the lower joints X and $X_1$ respectively in the latter layer. In FIG. 11A in which the relation $l_1 > l_2$ holds, a recess 4 is formed at the inner corner of the jointed area of the main leg steel sheet 1*a* having the greater width, while in FIG. 11B in which the relation $l_1 < l_2$ holds, such recess 4 is formed at the inner corner of the jointed area of the yoke steel sheet 3*a* having the greater width.

Figure 12A:
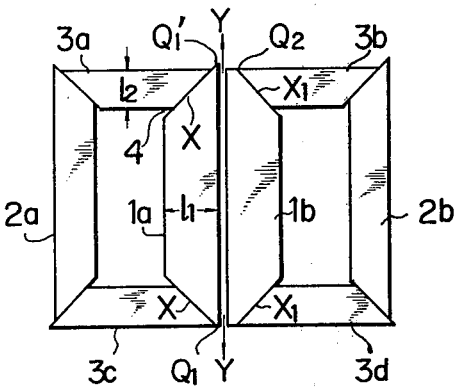
FIGS. 12A and 12B show the structure of still another embodiment of the present invention.
Figure 12B:
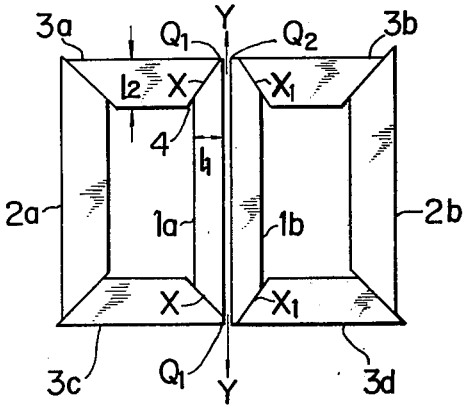

FIGS. 12A and 12B show still another embodiment of the single-phase three-legged core according to the present invention. Referring to FIGS. 12A and 12B, a pair of main leg steel sheets 1*a* and 1*b* of different shapes constitute one layer of laminations of a main leg 1. The main leg steel sheet 1*a* is jointed at its diagonally cut sides to corresponding sides of yoke steel sheets 3*a* and 3*c* constituting one layer of laminations of upper and lower yokes 3 to form a pair of joints X, while the main leg steel sheet 1*b* is similarly jointed to yoke steel sheets 3*b* and 3*d* to form another pair of joints $X_1$. In the core layer adjoining that shown in FIGS. 12A and 12B, the pattern is inverted with respect to the axis Y—Y. Thus, the upper joints X and $X_1$ in the former layer adjoin the upper joints $X_1$ and X respectively in the latter layer, and the lower joints X and $X_1$ in the former layer adjoin the lower joints $X_1$ and X respectively in the latter layer. A recess 4 is formed at the inner corner of the jointed area of the steel sheet 1*a* or 3*a* depending on the relative width, and an outer corner point $Q_1$ is formed at the outer corner of the joint X.

It will be understood from the foregoing detailed description that, in the single-phase three-legged core according to the present invention, a plurality of main leg steel sheets constituting layers of laminations of a main leg are jointed at their diagonally cut sides to corresponding sides of a plurality of steel sheets constituting layers of laminations of a pair of yokes to form a plurality of joints, and at the inner corner portion of each joint, a recess is provided along the main leg or yoke steel sheet having a greater width than the other, while at the outer corner portion of some of the joints, the vertex of the diagonally cut side of the corresponding main leg steel sheet mates with that of the associated yoke steel sheet to provide an outer corner point. Thus, a plurality of main leg steel sheets constituting main leg laminations of stepwise varying width can be jointed to a plurality of yoke steel sheets constituting yoke laminations at the same joint angle in the area of the recesses, and the number of clipped ends can be reduced to less than hitherto. Therefore, the number of cutting angles for these steel sheets can be decreased to reduce the steps of cutting thereby improving the yield rate. Further, magnetic flux can uniformly flow through the joints having the outer corner points to minimize the core loss.

I claim:

1. A single-phase three-legged core for a core type transformer comprising:

a main leg of substantially circular cross-sectional shape constituted by laminating a plurality of pairs of main leg steel sheets into masses of laminations having a stepwise varying width, each sheet having at both ends thereof diagonally cut sides, said main leg steel sheets of each pair being spaced from each other with a predetermined space to define an oil duct;

a pair of side legs constituted by laminating a plurality of side leg steel sheets into masses of laminations, each side leg steel sheet having at both ends thereof diagonally cut sides, said side legs being spaced at opposite sides of the main leg such that their diagonally cut sides are opposite diagonally cut sides of said main leg; and a pair of yokes of non-circular cross-sectional shape constituted by laminating a plurality of yoke steel sheets into masses of laminations which are non-circular in cross-section, each of said yoke steel sheets having at both ends thereof diagonally cut sides adapted to form miter joints in cooperation with the diagonally cut sides of the side leg and main leg steel sheets so as to form a plurality of magnetic joints between both ends of the main leg and a side leg;

wherein a predetermined one of said plural joints is provided at the outer side thereof with a first joint having an outer corner point at which the vertices of the diagonally cut sides of the main leg steel sheet and the yoke steel sheet meet, and wherein another main leg steel sheet is disposed at the side of the yoke steel sheet of said first joint in overlapped-relation to said first joint so as to form a second joint in which the diagonally cut side of said another main leg steel sheet is miter-joined to the corresponding diagonally cut side of another yoke steel sheet, the joint angle of said first joint being made to be of the same value as that of the second joint, and wherein a recess is provided at the inner side of each of said joints on the side of the wider steel sheet of the respective cooperating steel sheets;

and wherein in each of said first and second joints the effective width in the joint area of the wider steel sheet of the respective cooperating steel sheets is greater than the width of the cooperating narrower steel sheet and the joint angle with respect to the longitudinal axis of the respective cooperating wider steel sheet is greater than 45° so that undesirable local concentrations of magnetic flux are avoided.

2. A single-phase three-legged core as claimed in claim 1, wherein at least two of said plural joints are of said first joint type disposed opposite to each other through the oil duct at the upper part of said core and each including said outer corner point formed by the mating vertices of the diagonally cut sides of said main leg and yoke steel sheets.

3. A single-phase three-legged core as claimed in claim 1, wherein at least two of said plural joints are of first and second types respectively disposed opposite to each other at the upper part of said core through the oil duct, said first type including said outer corner point formed by the mating vertices of the diagonally cut sides of said main leg and yoke steel sheets, while said second type not including such outer corner point.

4. In a single-phase three-legged core for a core type transformer comprising a main leg, a pair of side legs spaced at opposite sides of the main leg, and yokes magnetically joining both ends of the main leg to respective ends of the side legs for establishing a magnetic circuit, wherein each of said main and side legs and said yokes is formed as a lamination of a plurality of sheets, wherein at least the ends of the sheets of said main leg and the adjacent ends of the sheets of said yokes have diagonally cut sides, and wherein at least some of the sheets of said main leg differ in width from said yoke sheets, the diagonally cut sides of said yoke sheets forming miter joints in cooperation with the diagonally cut sides of the main leg sheets so as to form a plurality of joints for magnetically joining both ends of the main leg to respective ends of the side legs for establishing said magnetic circuit; the improvement comprising providing at least one of said plurality of joints with a first joint having an outer corner-point at which the vertices of the diagonally cut sides of a main leg sheet and a yoke sheet meet, said main leg sheet and said yoke sheet having different widths, and wherein another main leg sheet is disposed at the side of the yoke sheet of said first joint in overlapped-relation to said first joint so as to form a second joint in which the diagonally cut side of said another main leg sheet is miter-joined to the corresponding diagonally cut side of another yoke sheet, said another main leg sheet and said another yoke sheet having different widths, the joint angle of said first joint being the same as that of said second joint, and wherein a recess is provided at the inner side of each of said first and second joints on the side of the wider sheet of the respective cooperating sheets;

and wherein in each of said first and second joints the effective width in the joint area of the wider steel sheet of the respective cooperating steel sheets is greater than the width of the cooperating narrower steel sheet and the joint angle with respect to the longitudinal axis of the respective cooperating wider steel sheet is greater than 45° so that undesirable local concentrations of magnetic flux are avoided.

5. A single-phase three-legged core as claimed in claim 4, wherein said main leg has a substantially circular cross-sectional shape which is formed as a lamination of a plurality of pairs of main leg sheets having stepwise varying widths, said main leg sheets of each pair being spaced from each other with a predetermined space to define an oil duct.

6. A single-phase three-legged core as claimed in claim 5, wherein said yokes have a non-circular cross-sectional shape.

7. A single-phase three-legged core as claimed in claim 6, wherein said sheets of said main leg, side legs and yokes are made of steel.

8. A single-phase three-legged core as claimed in claim 5, wherein at least two of said plurality of joints are of said first joint type disposed opposite to each other through the oil duct at the upper part of said core and each including said outer corner point formed by the mating vertices of the diagonally cut sides of said main leg and yoke steel sheets.

9. A single-phase three-legged core as claimed in claim 5, wherein at least two of said plural joints are of first and second types respectively disposed opposite to each other at the upper part of said core through the oil duct, said first type including said outer corner point formed by the mating vertices of the diagonally cut sides of said main leg and yoke steel sheets, while said second type not including such outer corner points.

10. A single-phase three-legged core as claimed in claim 4, wherein said another main leg sheet has a width different from the width of the main leg sheet of said first joint.

11. In a joint arrangement in a core for a core-type transformer comprising a core including at least first and second core sections each formed of laminations of sheets, the sheets of at least one end of each core section having diagonally cut sides and at least some of the sheets of said first core section differing in width from the sheets of said second core section, said first and second core sections being positioned so that respective ends thereof having sheets with diagonally cut sides are next to each other so that the respective diagonally cut sides of the sheets form a plurality of miter joints in cooperation with one another for magnetically joining the first and second core sections; the improvement comprising providing at least one of said plurality of joints with a first joint having an outer corner-point at which the vertices of the diagonally cut sides of a first core section sheet and a second core section sheet meet, said first core section sheet and said second core section sheet having different widths, and wherein another first core section sheet is disposed at the side of the second core section sheet of said first joint in overlapped-relation to said first joint so as to form a second joint in which the diagonally cut side of said another first core section sheet is miter-joined to the corresponding diagonally cut side of another second core section sheet, said another first core section sheet and said another second core section sheet having different widths, and wherein a recess is provided at the inner side of each of said first and second joints on the side of the wider sheet of the respective cooperating sheets;

and wherein in each of said first and second joints the effective width in the joint area of the wider steel sheet of the respective cooperating steel sheets is greater than the width of the cooperating narrower steel sheet and the joint angle with respect to the longitudinal axis of the respective cooperating wider steel sheet is greater than 45° so that undesirable local concentrations of magnetic flux are avoided.

12. The joint arrangement of claim 11, wherein the joint angle of said first joint is the same as that of said second joint.

* * * * *